US010767901B2

(12) United States Patent
Ono

(10) Patent No.: US 10,767,901 B2
(45) Date of Patent: Sep. 8, 2020

(54) COMBUSTION APPARATUS

(71) Applicant: RINNAI CORPORATION, Aichi (JP)

(72) Inventor: Takahiro Ono, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 172 days.

(21) Appl. No.: 16/211,506

(22) Filed: Dec. 6, 2018

(65) Prior Publication Data

US 2019/0186785 A1 Jun. 20, 2019

(30) Foreign Application Priority Data

Dec. 19, 2017 (JP) ..... 2017-242666

(51) Int. Cl.

| | |
|---|---|
| ***F23D 14/14*** | (2006.01) |
| ***F24H 1/14*** | (2006.01) |
| ***F28F 1/14*** | (2006.01) |
| ***F23D 14/56*** | (2006.01) |
| ***F24H 9/18*** | (2006.01) |
| ***F23D 14/64*** | (2006.01) |
| ***F24H 9/02*** | (2006.01) |
| ***F23D 14/02*** | (2006.01) |

(52) U.S. Cl.

CPC ..... *F24H 1/145* (2013.01); *F23D 14/02* (2013.01); *F23D 14/14* (2013.01); *F23D 14/56* (2013.01); *F23D 14/64* (2013.01); *F24H 9/02* (2013.01); *F24H 9/1836* (2013.01); *F28F 1/14* (2013.01); *F23D 2203/10* (2013.01); *F23D 2900/00019* (2013.01)

(58) Field of Classification Search

CPC ..... F23M 5/08; F23D 14/14; F23D 14/76; F23D 14/78; F24H 9/00; F24H 2210/00; F24H 1/14

See application file for complete search history.

(56) References Cited

U.S. PATENT DOCUMENTS

| | | | | |
|---|---|---|---|---|
| 10,527,279 | B2 * | 1/2020 | Ojiro | F24H 1/124 |
| 10,571,152 | B2 * | 2/2020 | Matsunaga | F23J 13/04 |
| 10,612,776 | B2 * | 4/2020 | Ono | F23D 14/14 |
| 2010/0116226 | A1 * | 5/2010 | Lovascio | F23D 14/02 122/367.1 |

(Continued)

FOREIGN PATENT DOCUMENTS

JP 2017-078542 A 4/2017

*Primary Examiner* — Gregory A Wilson

(74) *Attorney, Agent, or Firm* — Cermak Nakajima & McGowan LLP; Tomoko Nakajima

(57) ABSTRACT

A combustion apparatus has a burner including a burner body and a combustion plate, as well as a combustion box. A combustion plate flange part projects outward beyond an inner rim of a body flange part and beyond an inner rim of a combustion box flange part. A packing has a portion interposed between the combustion plate flange part and the body flange part, and a portion interposed between the combustion box flange part and the body flange part outside an outer rim of the combustion plate flange part. A distribution plate having formed therein a multiplicity of distribution holes for introducing the air-fuel mixture toward an air-fuel mixture ejection part is provided with a distribution plate flange part so arranged as to come into direct contact with that portion of the combustion plate flange part which is positioned inside an inner rim of the packing.

5 Claims, 7 Drawing Sheets

(56) References Cited

U.S. PATENT DOCUMENTS

| | | | | |
|---|---|---|---|---|
| 2012/0301836 | A1* | 11/2012 | Akagi | F23D 14/14 431/328 |
| 2014/0000534 | A1* | 1/2014 | Naitoh | F23D 14/045 122/14.21 |
| 2018/0363897 | A1* | 12/2018 | Ono | F23D 14/02 |
| 2019/0024941 | A1* | 1/2019 | Ono | F23D 14/145 |
| 2020/0033002 | A1* | 1/2020 | Karaki | F23N 5/12 |
| 2020/0072497 | A1* | 3/2020 | Miura | F23D 14/14 |

* cited by examiner

COMBUSTION APPARATUS

TECHNICAL FIELD

The present invention relates to a combustion apparatus comprising: a burner made up of a burner body which is supplied therein with air-fuel mixture, and a combustion plate which covers an open surface of the burner body and which has an air-fuel mixture ejection part; and a combustion box which has, on a perimeter of one end, a combustion box flange part, adapted to be connected to a body flange part enclosing the open surface of the burner body, the combustion box containing therein a heat exchanger.

BACKGROUND ART

As this kind of combustion apparatus, there is known an apparatus in JP-A 2017-78542 having the following features. In other words, the combustion apparatus includes: a combustion plate flange part disposed on a perimeter of the combustion plate in a manner to project outward beyond an inner rim of the body flange part and beyond an inner rim of the combustion box flange part, and also in a manner that an outer rim of the combustion plate flange part is positioned inside an outer rim of the body flange part and inside an outer rim of the combustion box flange part; a packing having a portion interposed between the combustion plate flange part and the body flange part, and a portion interposed between the combustion box flange part and the body flange part outside the outer rim of the combustion plate flange part, such that the combustion box flange part is connected, with the packing being sandwiched therein, to the body flange part. According to this arrangement, the combustion plate flange part comes into direct contact with the combustion box flange part. Further, in that portion of the combustion box which lies between the burner and the heat exchanger, there is disposed cooling means such as water jackets and the like. Therefore, it is possible to release the heat of the combustion plate through the combustion plate flange part to the combustion box flange part to which the cold by the cooling means is transmitted.

However, since the combustion plate becomes considerably high in temperature during combustion, the temperature of the combustion plate flange part becomes high even in the above-mentioned construction. Therefore, the packing to be used must be of an expensive one with a high heat-resistance.

SUMMARY OF THE INVENTION

Problems that the Invention is to Solve

In view of the above-mentioned point, this invention has a problem of providing a combustion apparatus in which there can be used an inexpensive packing having a relatively low heat-resisting temperature as a packing.

Means for Solving the Problems

In order to solve the above problem, this invention is a combustion apparatus comprising: a burner made up of: a burner body which is supplied inside thereof with air-fuel mixture, and a combustion plate which covers an open surface of the burner body and which has an air-fuel mixture ejection part; a combustion box which has, on a perimeter of one end, a combustion box flange part, adapted to be connected to a body flange part enclosing an open surface of the burner body, and which contains therein a heat exchanger. The combustion apparatus further comprises: a combustion plate flange part disposed on a perimeter of the combustion plate in a manner to project outward beyond an inner rim of the body flange part and beyond an inner rim of the combustion box flange part, and also in a manner that an outer rim of the combustion plate flange part is positioned inside an outer rim of the body flange part and inside an outer rim of the combustion box flange part; a packing having a portion interposed between the combustion plate flange part and the body flange part, and a portion interposed between the combustion box flange part and the body flange part outside the outer rim of the combustion plate flange part, such that the combustion box flange part is connected, with the packing being sandwiched therein, to the body flange part; and a distribution plate having formed therein a multiplicity of distribution holes for introducing the air-fuel mixture toward the air-fuel mixture ejection part. The distribution plate is provided, on an outer rim thereof, with a distribution plate flange part arranged to come into direct contact with that portion of the combustion plate flange part which is positioned inside an inner rim of the packing.

Since the air-fuel mixture within the burner body passes through the distribution plate, the distribution plate is cooled by the air-fuel mixture. Then, according to this invention, since the distribution plate flange part comes into direct contact with the combustion plate flange part, the temperature in the combustion plate flange part lowers due to heat dissipation from the combustion plate flange part to the distribution plate. As a result, an inexpensive packing having a relatively low heat-resisting temperature as a packing comes to be made available.

In this invention, preferably the combustion plate is formed into a drawn shape (i.e., by a drawing process) having a recessed part which is depressed toward the combustion box side relative to the combustion plate flange part such that the air-fuel mixture ejection part is disposed in a bottom surface of the recessed part. The distribution plate is also preferably formed into a drawn shape having a recessed part which is depressed toward the combustion box side relative to the distribution plate flange part such that the air-fuel mixture distribution holes are formed at the bottom surface of the recessed part and that the recessed part of the distribution plate is inserted into an inside of the recessed part of the combustion plate. For the purpose of cleaning the air-fuel mixture ejection part, it is necessary to arrange the distribution plate to be detachable. As described above, by arranging such that the recessed part of the distribution plate is inserted into the inside of the recessed part of the combustion plate, the distribution plate can be easily fixed in position relative to the combustion plate, thereby improving the ease of maintenance.

The combustion apparatus may further comprise a projection part which is formed in the combustion plate flange part so as to come into engagement with a hole formed in the distribution plate flange part so that the distribution plate can be fixed in position.

In this invention, in case there is provided an ignition plug which is inserted into the combustion box in a manner to face a part of the air-fuel mixture ejection part, wherein the diameter of distribution holes formed in that portion to face the air-fuel mixture ejection part which is made to face the ignition plug is larger than the diameter of the distribution holes formed in other portions. According to this arrangement, the air-fuel mixture is quickly ejected out of the portion of the air-fuel mixture ejection part to which the ignition plug is caused to face, thereby shortening the time to the ignition.

EMBODIMENTS FOR CARRYING OUT THE INVENTION

Figure 1:
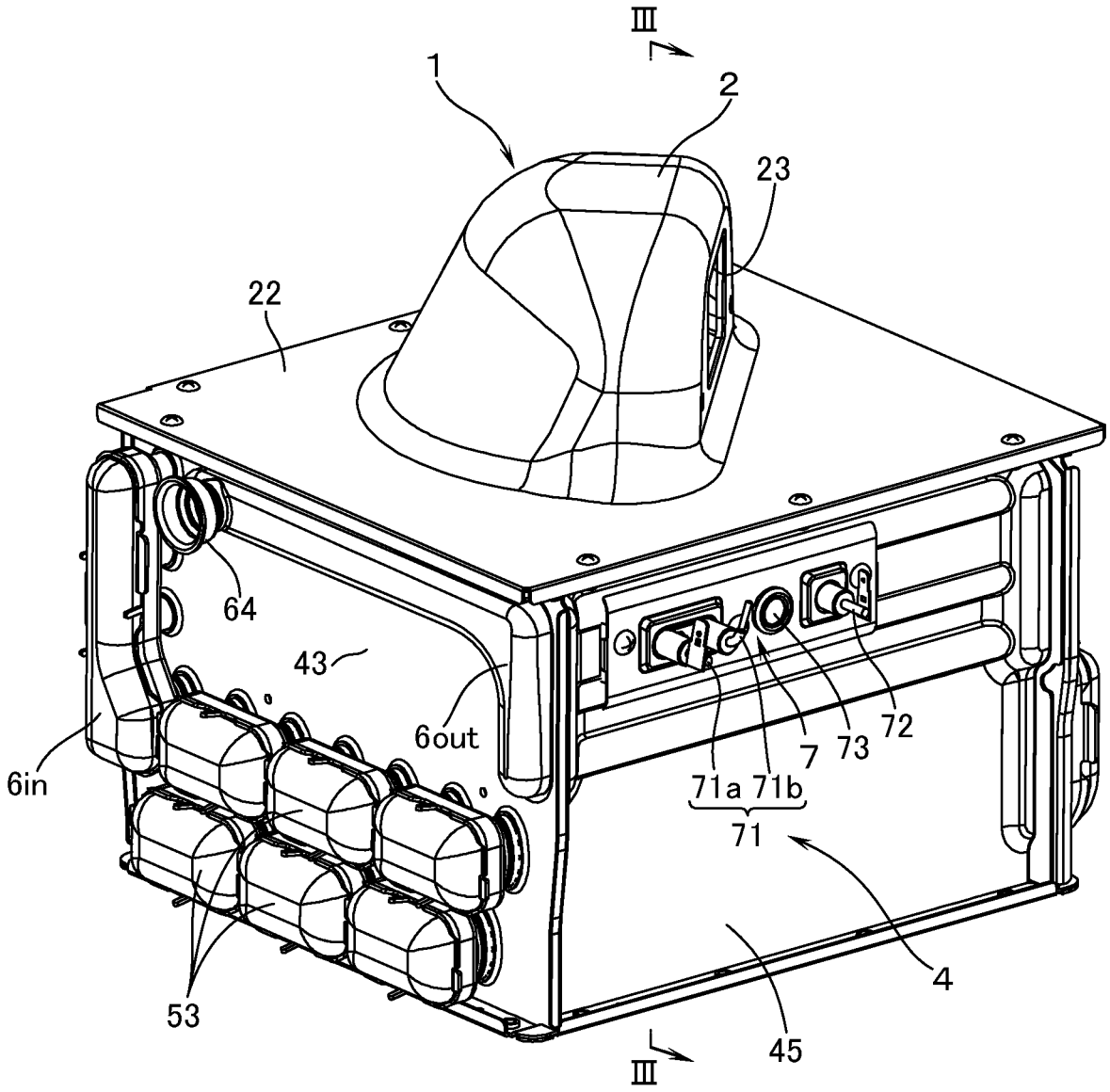
FIG. 1 is a perspective view of a combustion apparatus according to an embodiment of this invention.
Figure 2:
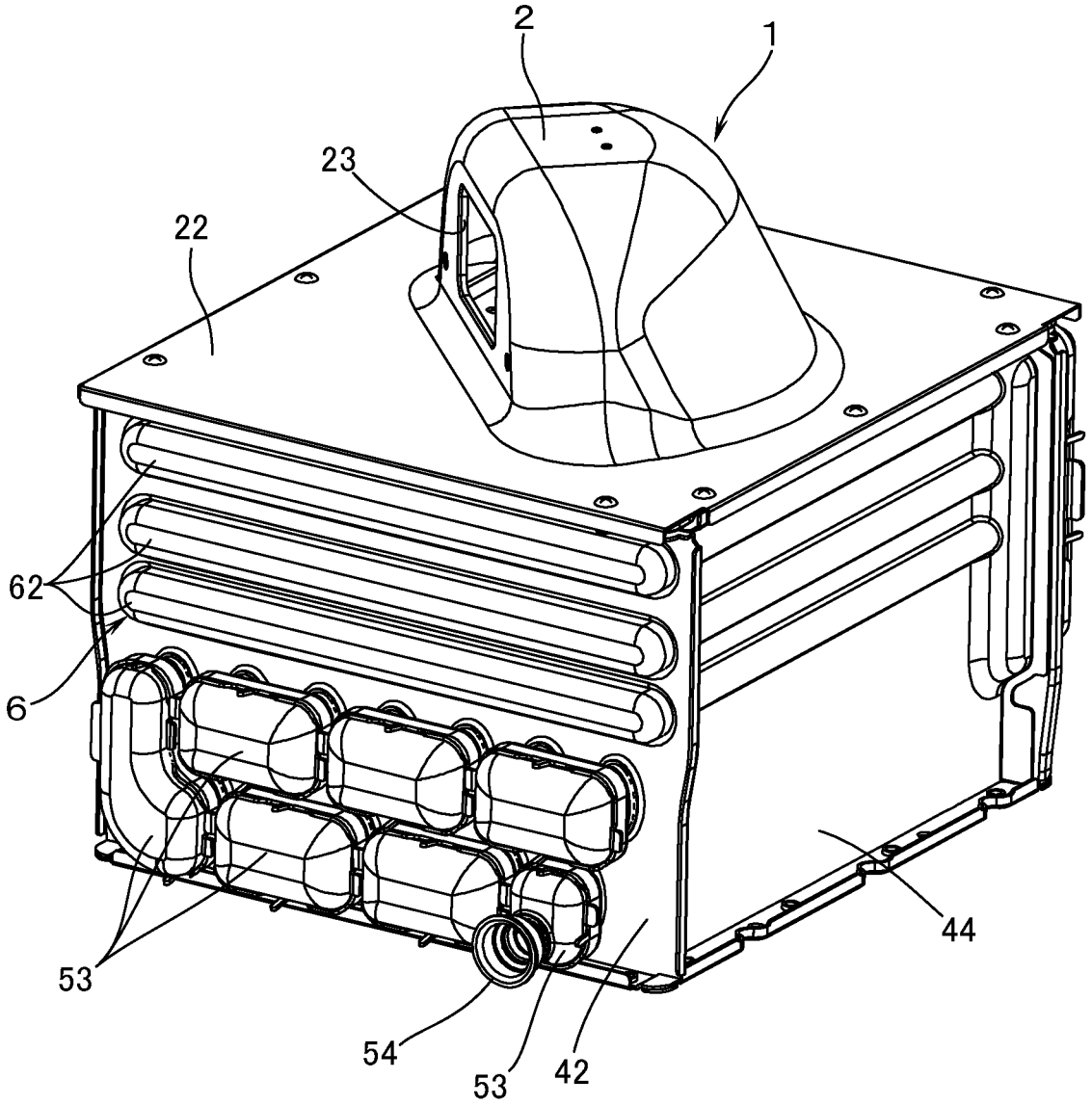
FIG. 2 is a perspective view of the combustion apparatus of the embodiment as viewed from a side opposite to that in FIG. 1.
Figure 3:
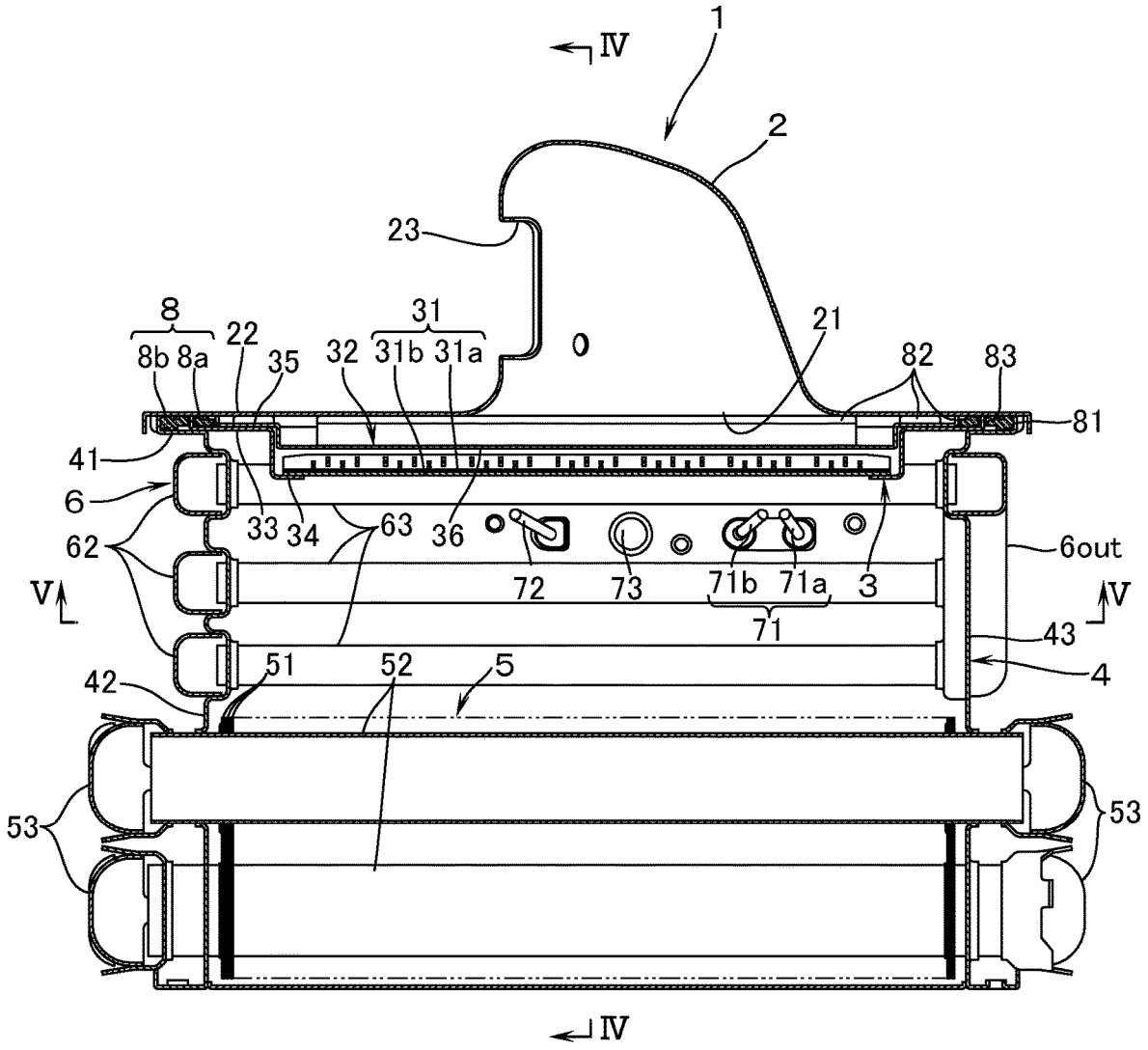
FIG. 3 is a sectional view cut away along the line III-III in FIG. 1.
Figure 4:
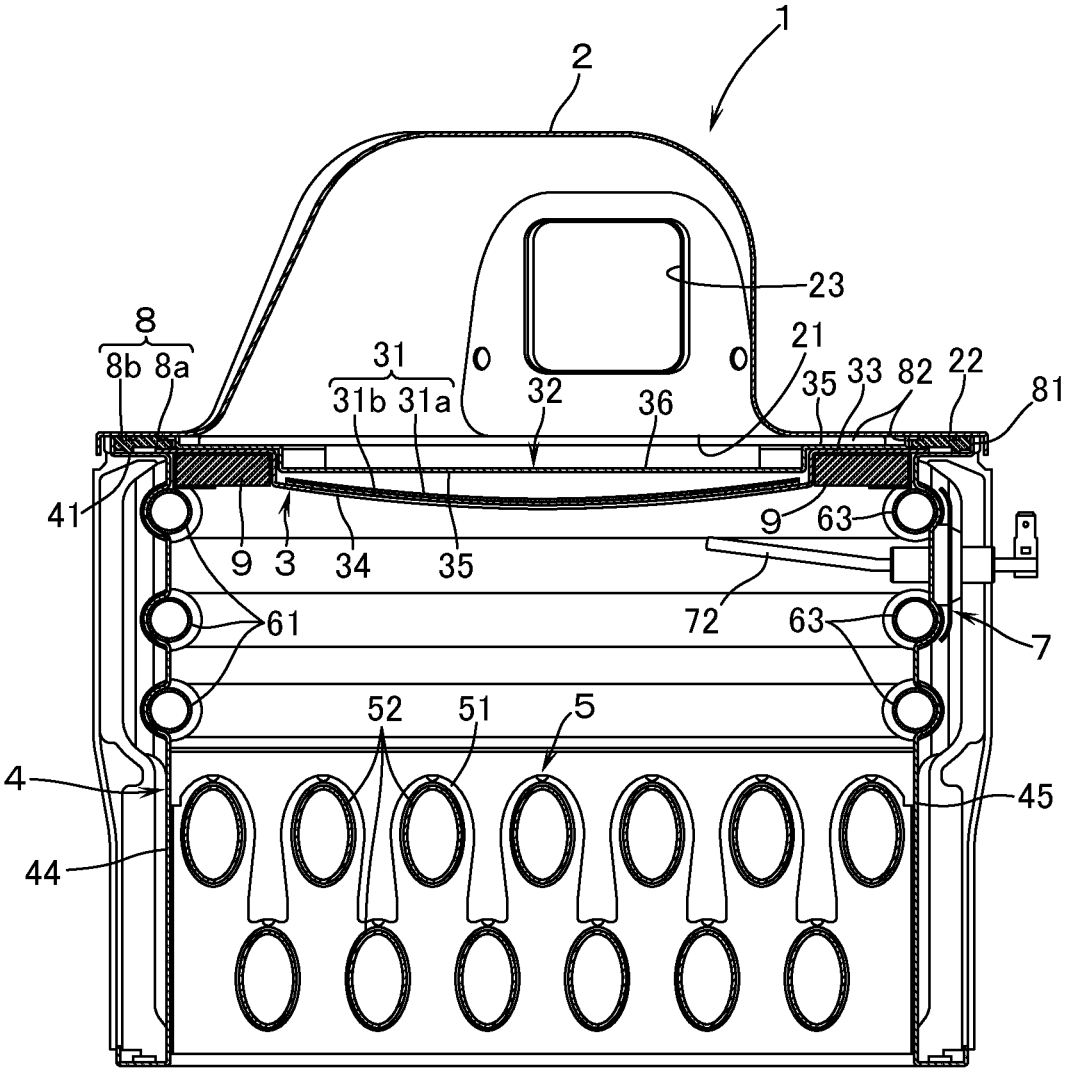
FIG. 4 is a sectional view cut away along the line IV-IV in FIG. 3.

With reference to FIGS. 1 to 4, a combustion apparatus according to an embodiment of this invention is provided with: a burner 1 made up of a burner body 2 which is supplied inside thereof with air-fuel mixture (mixture gas of fuel gas and primary air); and a combustion plate 3, made of a sheet metal and having an air-fuel mixture ejection part 31, the combustion plate 3 covering a downward open surface 21 of the burner body 2; and a combustion box 4 of a sheet-metal make which has, on a perimeter of an upper end, a combustion box flange part 41 to be connected to a body flange part 22 which encloses the open surface 21 of the burner body 2. The combustion box 4 contains, inside thereof, a heat exchanger 5 for supplying hot water.

On a side surface of the portion swollen upward in the central part of the burner body 2, there is provided an inlet port 23 to which is connected a fan (not illustrated) for supplying air-fuel mixture. The combustion plate 3 has a large opening in the center thereof. This opening has mounted thereon a burner port plate 31*a* which has formed therein a multiplicity of burner ports in a manner overlapped on a lower surface with woven fabric 31*b* of heat-resistant fiber. The burner port plate 31*a* and the woven fabric 31*b* constitute the air-fuel ejection part 31. In addition, the combustion plate 3 is provided with a distribution plate 32 which has formed therein a multiplicity of distribution holes 32*a* (see FIG. 7) positioned above the burner port plate 31*a*. The air-fuel mixture supplied from the fan into the burner body 2 is introduced, through the distribution plate 32, into the air-fuel ejection part 31 for further ejection out of the air-fuel ejection part 31, thereby performing totally primary air combustion. The reason why the distribution plate 32 is disposed is, even if the space for distributing the air-fuel mixture inside the burner body 2 is narrowed for downsizing of the burner 1, to enable the air-fuel mixture to be evenly introduced into an entire region of the air-fuel mixture ejection part 31. By the way, it is also possible to form a multiplicity of burner ports in a combustion plate having no large opening, and an air-fuel mixture ejection part is constituted by these burner ports.

The heat exchanger 5 is constituted by a fin-tube type of heat exchanger having: a multiplicity of fins 51; and a plurality of heat-absorbing pipes 52 which penetrate through these fins 51. On the outside of side plates 42, 43 on laterally one side and the other side of the combustion box 4, there are disposed a plurality of connection boxes 53 which connect connection passages for the adjoining two heat-absorbing pipes 52, 52. All the heat-absorbing pipes 52 are thus connected in series with one another. In addition, the connection box 53 to be connected to the heat absorbing pipe 52 on the upstream end, is provided with a cold water inlet 54.

Further, in that portion of the combustion box 4 which lies between the burner 1 and the heat exchanger 5, there is disposed, as cooling means for cooling the combustion box 4, a water jacket 6 which is connected to the downstream side of the heat exchanger 5. This water jacket 6 is constituted by the following, i.e.: laterally elongated three pieces of first water tubes 61 vertically arranged on a back-side side plate 44 of the combustion box 4; laterally elongated three pieces of third water tubes 63 vertically arranged on a front-side side plate 45 of the combustion box 4; three pieces of second water tubes 62 which are disposed on laterally one of the side plates 42 of the combustion box 4 and which are vertically arranged to be elongated in front-to-back direction so as to connect the first water tubes 61 and the third water tubes 63 together; an inlet-side header 6in disposed on an outside of the portion toward the back side of the laterally other of the side plates 43 of the combustion box 4, so as to introduce the water passed through the heat exchanger 5; and an outlet-side header 6out disposed on an outside of the portion toward the front side of, and on an upper portion of, the side plate 43 on the laterally the other of the combustion box 4. The outlet-side header 6out is provided with a hot water outlet port 64 to which is connected a hot-water supply passage. Water (hot water) passed through the heat exchanger 5 flows from the inlet-side header 6in through the first water tube 61, the second water tube 62, and the third water tube 63 into the outlet-side header 6out, and is supplied from the hot water outlet port 64 to the hot water supply passage.

Figure 5:
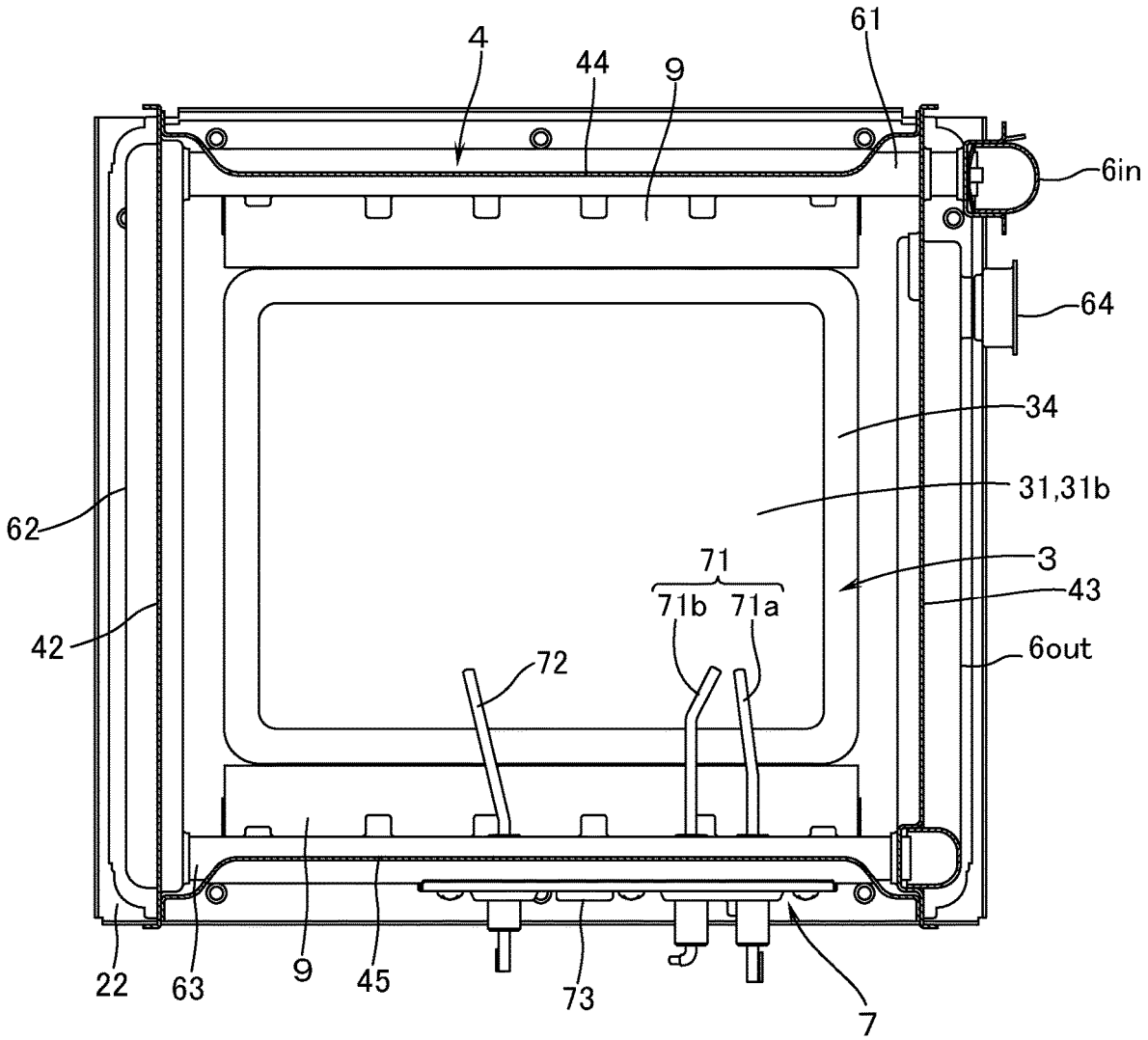
FIG. 5 is a sectional view cut away along the line V-V in FIG. 3.

With reference also to FIG. 5, the front-side side plate 45 of the combustion box 4 has mounted thereon electrode parts 7 having: an ignition plug 71 made up of an ignition electrode 71*a* and a ground electrode 71*b*, both penetrating through the side plate 45 to project into the combustion box 4; and a flame rod 72. By the way, the electrode parts 7 are additionally provided with an inspection window 73 which enables visual confirmation inside the combustion box 4.

Figure 6:
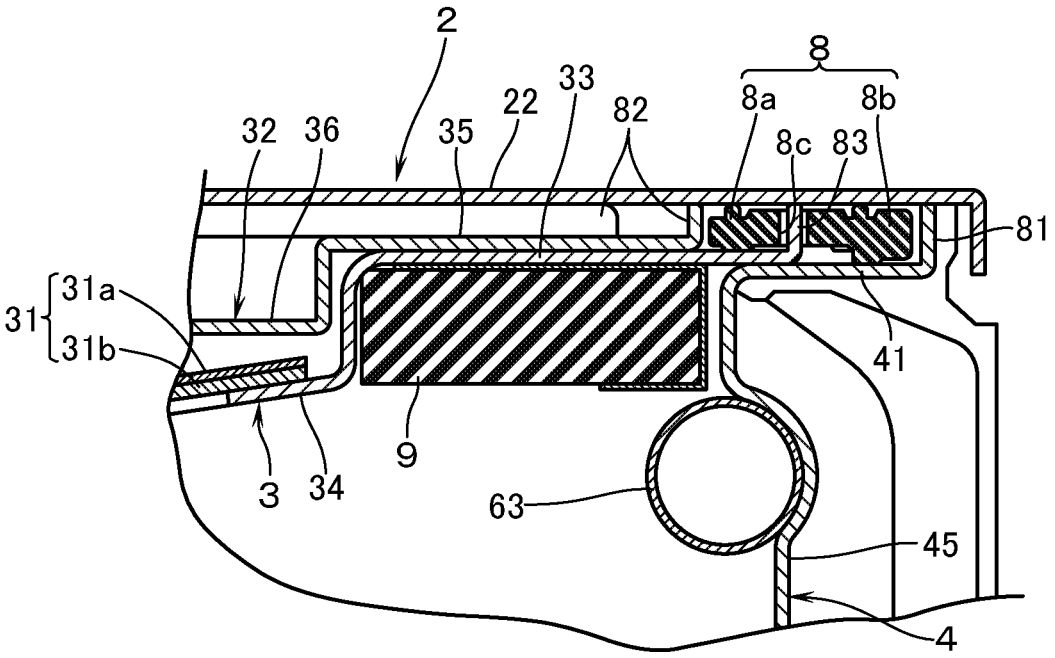
FIG. 6 is an enlarged sectional view of an essential part of the combustion apparatus of the embodiment.

As clearly shown in FIG. 6, on a perimeter of a combustion plate 3, there is provided a combustion plate flange part 33 which projects outward beyond an inner rim of the body flange part 22 and beyond an inner rim of the combustion box flange part 41, and an outer rim of the combustion plate flange part 33 is positioned inside an outer rim of the body flange part 22 and inside an outer rim of the combustion box flange part 41. And there is provided a packing 8 which has a portion 8*a* adapted to be interposed between the combustion plate flange part 33 and the body flange part 22 and a portion 8*b* adapted to be interposed between the combustion box flange part 41 and the body flange part 22 outside the outer rim of the combustion plate flange part 33. Further, it is so arranged that the combustion box flange part 41 is connected, with the packing being sandwiched therein, to the body flange part 22.

Here, according to this embodiment, the combustion plate flange part 33 will be brought into direct contact with the combustion box flange part 41. Therefore, the heat from the combustion plate 3 can be released to the combustion box flange part 41 to which the cold by the water jacket 6 is transmitted, and the temperature of the combustion plate flange part 33 is lowered to a certain degree. In addition, according to this embodiment, the distribution plate 32 is provided, on a perimeter thereof, with a distribution plate flange part 35 arranged to come into direct contact with that portion of the combustion plate flange part 33 which is positioned inside an inner rim of the packing 8. Since the air-fuel mixture inside the burner body 2 passes through the distribution plate 32, the distribution plate 32 will be cooled by the air-fuel mixture. Then, due to heat dissipation from the combustion plate flange part 33 through the distribution plate flange part 35, with which is brought into direct contact, to the distribution plate 32, the temperature of the combustion plate flange part 33 sufficiently lowers. As a result, an inexpensive packing 8 having a relatively low heat-resisting temperature can be used.

By the way, on that lower surface of the combustion plate flange part 33 in the front and back of the combustion plate 3 which is on the inner side projecting into the combustion box 4, a thermal insulation material 9 is mounted. According to this arrangement, there will be restrained the input of that heat to the combustion plate flange part 33 from the combustion gas which is generated by the combustion of the air-fuel mixture.

Figure 7:
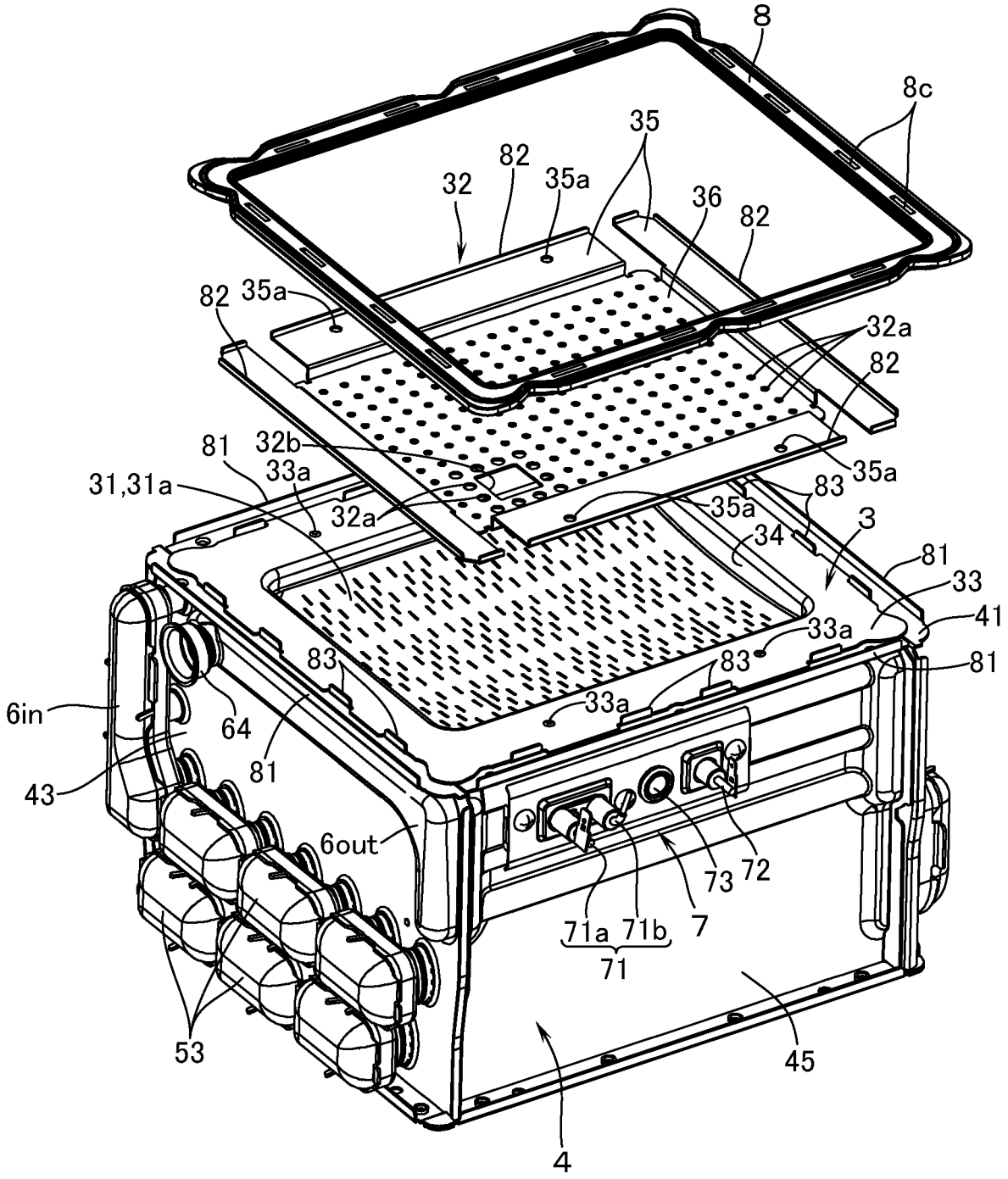
FIG. 7 is a perspective view of a combustion apparatus in an exploded state (burner body being omitted) of the combustion apparatus according to the embodiment.

In addition, with reference to FIG. 6 and FIG. 7, in this embodiment, on the outer rim of the combustion box flange part 41 there is formed an outside projection 81 which is erected, by bending, toward the body flange part 22 in a manner to face an outer rim of the packing 8. Also in the combustion plate 3, there is formed an inside projection 82 which is erected, by bending, toward the body flange part 22 in a manner to face the inner rim of the packing 8. Further, on the outer rim of the combustion plate flange part 33, there is formed, by bending, a claw part 83 which is to be inserted into a hole 8*c* formed in the packing 8. Then, by means of the outer projection 81, the inside projection 82, and the claw part 83, the packing 8 is arranged to be fixed in position. Still furthermore, in a state in which the combustion box flange part 41 has been connected to the body flange part 22, the outer projection 81, the inside projection 82, and the claw part 83 come into contact with the body flange part 22. According to this arrangement, the compression allowance is adequately managed. Further, the distribution plate flange part 35 is kept in a state of contact with the combustion plate flange part 33.

Further, the combustion plate 3 is formed into a drawn shape having a recessed part 34 which is depressed toward the combustion box 4 side (downward) relative to the combustion plate flange part 33. In this manner, the air-fuel mixture ejection part 31 is disposed on a bottom surface of the recessed part 34. The distribution plate 32 is also formed into a drawn shape having a recessed part 36 which is depressed toward the combustion box 4 relative to the distribution plate flange part 35. In this manner, the distribution holes 32*a* are formed on the bottom surface of the recessed part 36. It is then so arranged that the recessed part 36 of the distribution plate 32 will get inserted into an inside of the recessed part 34 of the combustion plate 3. It is to be noted here that, for the purpose of cleaning of the air-fuel mixture ejection part 31, the distribution plate 32 must be arranged to be detachable. As described above, by inserting the recessed part 36 of the distribution plate 32 into the inside of the recessed part 34 of the combustion plate 3, the distribution plate 32 can be easily positioned relative to the combustion plate 3, thereby improving the ease with which the maintenance work can be performed. In this embodiment, the combustion plate flange part 33 has formed therein projection parts 33*a* so as to come into engagement with holes 35*a* formed in the distribution plate flange part 35. It is thus so arranged that the positioning accuracy of the distribution plate 32 relative to the combustion plate 3 can be further improved.

Further, as clearly shown in FIG. 7, in that portion of the distribution plate 32 which faces the portion of the air-fuel mixture ejection part 31 having the ignition plug 71 facing thereto, larger distribution holes 32*b* are formed than the distribution holes 32*a* to be formed in other portions. Distribution holes 32*a* which enclose the distribution holes 32*b* are also formed relatively larger. According to this arrangement, the air-fuel mixture is quickly ejected out of that portion of the air-fuel mixture ejection part 31 to which the ignition plug 71 faces, so that the time to the ignition can be shortened.

Descriptions have so far been made of embodiments of this invention with reference to the drawings. However, this invention shall not be limited to the above. For example, in the above embodiments, the combustion box 4 contains therein the heat exchanger 5 for hot water supply. Heat exchangers other than for the purposes of supplying hot water for space heating, and the like, may also be contained in the combustion box 4. Further, in the above embodiments the burner body 2 has formed therein the open surface 21 looking downward. This invention is similarly applicable to a combustion apparatus in which the burner is disposed such that the open surface thereof looks upward.

EXPLANATION OF MARKS

1 burner
2 burner body
21 open surface
22 body flange part
3 combustion plate
31 air-fuel mixture ejection part
32 distribution plate
32*a* distribution hole
32*b* distribution hole to be formed in that portion of distribution plate which faces the air-fuel mixture ejection part having the ignition plug adjacent thereto
33 combustion plate flange part
33*a* projected part
34 recessed part of combustion plate
35 distribution flange part
35*a* hole
36 recessed part of distribution plate
4 combustion box
41 combustion box flange part
7 electrode parts
71 ignition plug
8 packing
8*a* packing portion adapted to be interposed between the combustion plate flange part and the body flange part
8*b* packing portion adapted to be interposed between the combustion plate flange part and the body flange part

The invention claimed is:

1. A combustion apparatus comprising:

a burner made up of: a burner body which is supplied inside thereof with air-fuel mixture, and a combustion plate which covers an open surface of the burner body and which has an air-fuel mixture ejection part;

a combustion box which has, on a perimeter of one end, a combustion box flange part, adapted to be connected to a body flange part enclosing an open surface of the burner body, and which contains therein a heat exchanger, the combustion apparatus further comprising;

a combustion plate flange part disposed on a perimeter of the combustion plate in a manner to project outward beyond an inner rim of the body flange part and beyond an inner rim of the combustion box flange part, and also in a manner that an outer rim of the combustion plate flange part is positioned inside an outer rim of the body flange part and inside an outer rim of the combustion box flange part;

a packing having a portion interposed between the combustion plate flange part and the body flange part, and a portion interposed between the combustion box flange part and the body flange part outside the outer rim of the combustion plate flange part, such that the combustion box flange part is connected, with the packing being sandwiched therein, to the body flange part; and a distribution plate having formed therein a multiplicity of distribution holes for introducing the air-fuel mixture toward the air-fuel mixture ejection part, wherein the distribution plate is provided, on an outer rim thereof, with a distribution plate flange part arranged to come into direct contact with that portion of the combustion plate flange part which is positioned inside an inner rim of the packing.

2. The combustion apparatus according to claim 1, wherein the combustion plate is formed into a drawn shape having a recessed part which is depressed toward the combustion box side relative to the combustion plate flange part such that the air-fuel mixture ejection part is disposed in a bottom surface of the recessed part, and wherein the distribution plate is also formed into a drawn shape having a recessed part which is depressed toward the combustion box side relative to the distribution plate flange part such that the air-fuel mixture distribution holes are formed at a bottom surface of the recessed part and that the recessed part of the distribution plate is inserted into an inside of the recessed part of the combustion plate.

3. The combustion apparatus according to claim 2, further comprising a projection part which is formed in the combustion plate flange part so as to come into engagement with a hole formed in the distribution plate flange part.

4. The combustion apparatus according to claim 1, further comprising a projection part which is formed in the combustion plate flange part so as to come into engagement with a hole formed in the distribution plate flange part.

5. The combustion apparatus according to claim 1, further comprising an ignition plug which is inserted into the combustion box in a manner to face a part of the air-fuel mixture ejection part, wherein the diameter of distribution holes formed in that portion to face the air-fuel mixture ejection part which is made to face the ignition plug is larger than the diameter of the distribution holes formed in remaining portion to face the air-fuel mixture ejection holes.

* * * * *